US012680407B2

(12) United States Patent
Schultz et al.

(10) Patent No.: US 12,680,407 B2
(45) Date of Patent: Jul. 14, 2026

(54) DOWNHOLE RELEASABLE VIBRATORY TOOL, SYSTEM AND METHOD

(71) Applicant: THRU TUBING SOLUTIONS, INC., Newcastle, OK (US)

(72) Inventors: Roger L. Schultz, Ninnekah, OK (US); Robert Phillis, Camrose (CA)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 38 days.

(21) Appl. No.: 18/664,555

(22) Filed: May 15, 2024

(65) Prior Publication Data

US 2024/0384616 A1 Nov. 21, 2024

Related U.S. Application Data

(60) Provisional application No. 63/502,771, filed on May 17, 2023.

(51) Int. Cl.
*E21B 31/00* (2006.01)

(52) U.S. Cl.
CPC ..... *E21B 31/005* (2013.01)

(58) Field of Classification Search
CPC ..... E21B 28/00; E21B 31/005
See application file for complete search history.

(56) References Cited

U.S. PATENT DOCUMENTS 2,743,083 A 4/1956 Zublin
3,335,801 A * 8/1967 Wilsey ..... E21B 28/00 166/177.4
3,422,894 A 1/1969 Brandon
3,464,120 A 9/1969 Alder
3,557,875 A * 1/1971 Solum ..... E21B 28/00 166/278
4,058,163 A 11/1977 Yandell
4,890,682 A 1/1990 Worrall et al.
5,893,383 A 4/1999 Facteau
8,167,051 B2 5/2012 Eddison et al.
8,424,605 B1 * 4/2013 Schultz ..... E21B 33/16 166/177.6
9,033,003 B2 5/2015 Standen et al.
9,366,100 B1 6/2016 Baudoin
9,506,318 B1 * 11/2016 Brunet ..... E21B 33/16
9,637,991 B2 5/2017 Eddison et al.
9,915,107 B1 3/2018 Schultz et al.
10,724,318 B2 7/2020 Schultz et al.
10,781,654 B1 * 9/2020 Schultz ..... E21B 37/10
(Continued)

OTHER PUBLICATIONS

Canadian Examination Report issued Oct. 21, 2025 for CA Patent Application No. 3,238,730, 3 pages.

*Primary Examiner* — Shane Bomar
(74) *Attorney, Agent, or Firm* — Smith IP Services, P.C.

(57) ABSTRACT

A vibratory tool for use in a subterranean well can include an outer housing, an insert configured to produce vibrations in a tubular string in the well, and a release member that releasably secures the insert in the outer housing. A method for use with a subterranean well can include connecting at least one vibratory tool in a tubular string, the vibratory tool including an insert releasably secured in an outer housing, positioning the tubular string in the well, then releasing the insert from the outer housing in the well, and displacing the insert through the tubular string.

20 Claims, 8 Drawing Sheets

(56) References Cited

U.S. PATENT DOCUMENTS

| | | | | |
|---|---|---|---|---|
| 2005/0284624 | A1* | 12/2005 | Libby | E21B 28/00 166/177.6 |
| 2009/0223676 | A1 | 9/2009 | Eddison et al. | |
| 2009/0266612 | A1 | 10/2009 | Allahar et al. | |
| 2010/0193187 | A1 | 8/2010 | Briquet et al. | |
| 2011/0100468 | A1 | 5/2011 | Brunskill et al. | |
| 2011/0203809 | A1 | 8/2011 | Knobloch, Jr. et al. | |
| 2011/0290485 | A1* | 12/2011 | Cooke, Jr. | E21B 33/14 166/177.4 |
| 2012/0031615 | A1 | 2/2012 | Connell et al. | |
| 2012/0193145 | A1 | 8/2012 | Anderson | |
| 2015/0144342 | A1* | 5/2015 | Schultz | E21B 21/103 166/298 |
| 2015/0275605 | A1* | 10/2015 | Bennett | E21B 10/32 166/55.1 |
| 2017/0159387 | A1 | 6/2017 | Johnson | |
| 2019/0153820 | A1 | 5/2019 | Lorenson et al. | |
| 2021/0047894 | A1* | 2/2021 | Robertson | E21B 4/12 |
| 2022/0220819 | A1* | 7/2022 | Schultz | E21B 23/0413 |
| 2022/0307338 | A1* | 9/2022 | Hitchcock | E21B 33/14 |
| 2023/0003099 | A1* | 1/2023 | Rossing | E21B 28/00 |
| 2025/0207472 | A1* | 6/2025 | Schultz | E21B 23/10 |

* cited by examiner

DOWNHOLE RELEASABLE VIBRATORY TOOL, SYSTEM AND METHOD

CROSS-REFERENCE TO RELATED APPLICATION

This application claims the benefit of the filing date of U.S. provisional application No. 63/502,771 filed on 17 May 2023. The entire disclosure of the prior application is hereby incorporated herein in its entirety for all purposes.

BACKGROUND

This disclosure relates generally to equipment utilized and operations performed in conjunction with a subterranean well and, in an example described below, more particularly provides a downhole releasable vibratory tool and associated systems and methods.

A vibratory tool can be used to facilitate movement of a tubular string (such as, a casing, liner, tubing, pipe or drill string) along a wellbore. Vibrations produced by the vibratory tool can be a result of pressure fluctuations or changes in momentum (such as, due to variations in flow rate through the vibratory tool).

It will, therefore, be readily appreciated that improvements are continually needed in the art of designing, constructing and utilizing vibratory tool systems with subterranean wells. Such improvements can be used with a wide variety of different types of vibratory tools including, but not limited to, vibratory tools that produce pressure fluctuations or changes in momentum due to variations in flow rate through the vibratory tools.

DETAILED DESCRIPTION

Figure 1:
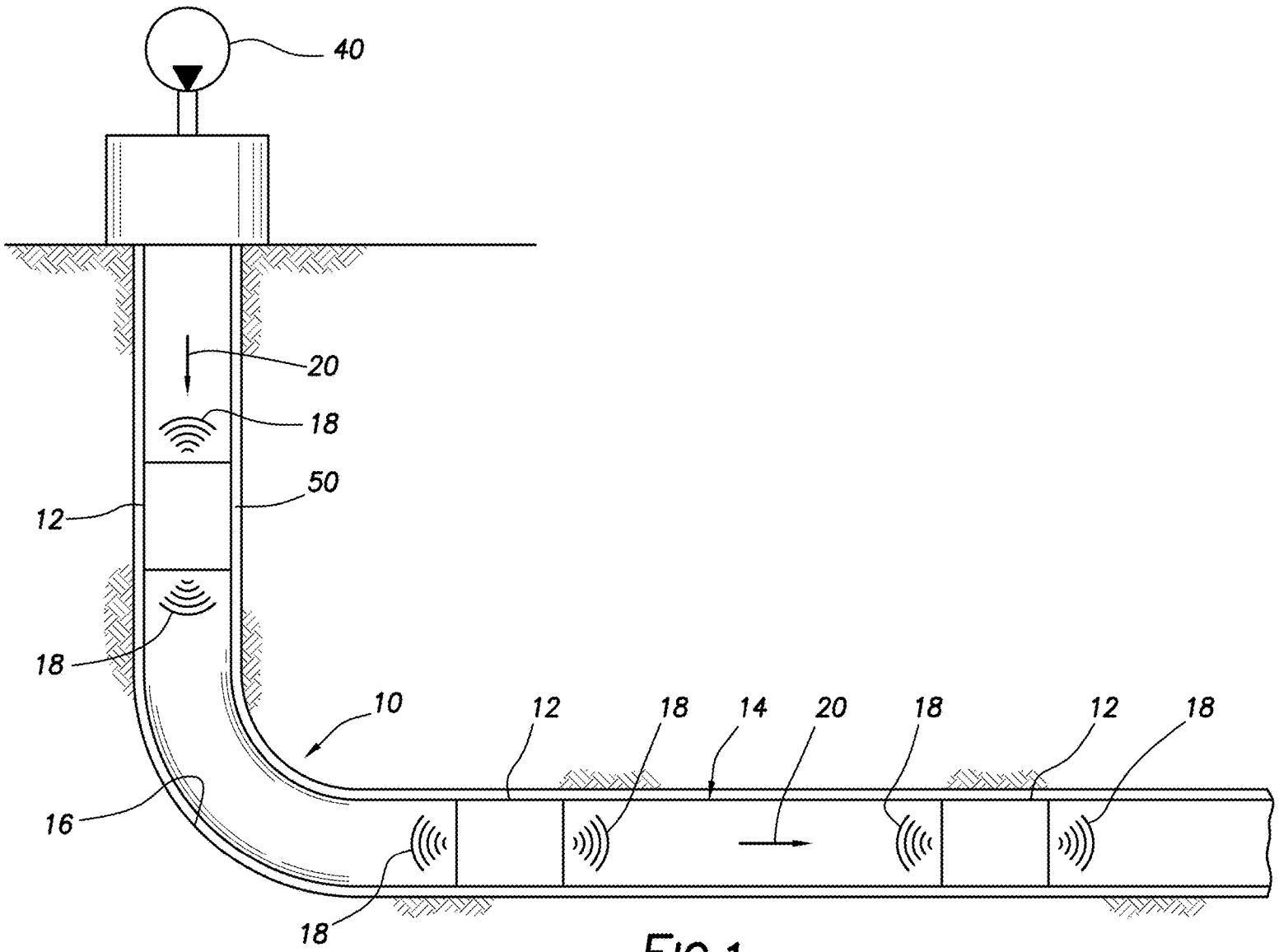
FIG. 1 is a representative partially cross-sectional view of an example of a well system and associated method which can embody principles of this disclosure.

Representatively illustrated in the accompanying drawings is a releasable downhole vibratory tool, a system for use with a subterranean well, and an associated method which can embody principles of this disclosure. However, it should be clearly understood that the tool, system and method are merely one example of an application of the principles of this disclosure in practice, and a wide variety of other examples are possible. Therefore, the scope of this disclosure is not limited at all to the details of the tool, system and method described herein and/or depicted in the drawings.

This disclosure describes a downhole vibratory tool system that can be deployed anywhere along the length of a tubular conduit in a well bore. One or more of these devices can be installed at any location along the tubular conduit where it is desired to create vibratory forces for improved pipe conveyance, improved cementation or any other desirable effect of vibration during downhole operations.

The tubular conduit or tubular string may comprise any type or combination of tubulars (such as, the types known to those skilled in the art as casing, liner, jointed tubing, coiled tubing, drill pipe, screen, etc.). In any examples described below in which a vibratory tool is used with a casing string, it should be understood that the vibratory tool could instead be used with another type of tubular string.

Vibratory force can have several benefits. One benefit is the breaking of static friction between the wellbore and a casing string (or other tubular string), which aids in moving the casing into the well. Other benefits can include improved cement flow and mud removal (reduced channeling), improved cement-to-casing bond and lower required torque when rotating casing. However, the scope of this disclosure is not limited to achievement of any particular benefit or benefits from use of a vibratory tool with a tubular string in a well.

Current systems only allow vibratory tools to be placed very near a distal end of the casing string. Placing vibratory tools further uphole and at multiple locations in a tubular string can be beneficial, but thus far has been impractical for casing strings because cement plugs must be pumped through the casing to facilitate cementing operations, which typically must be undertaken very soon after the casing is landed at a bottom of the well.

The concepts described herein include the ability to release internal vibratory tool component(s) after initially using the tool(s) to create vibration anywhere in the well along a tubular string (such as, a casing string). The released internal component can then be pumped to a toe of the well, thereby leaving a substantially open conduit.

This can be particularly useful when vibratory tools are to be used at intermediate locations within casing strings. Example systems described herein can allow for normal cement plugs and cementation operations to be conducted after cement is run into the well with intermediately placed vibratory tools.

Figure 2:
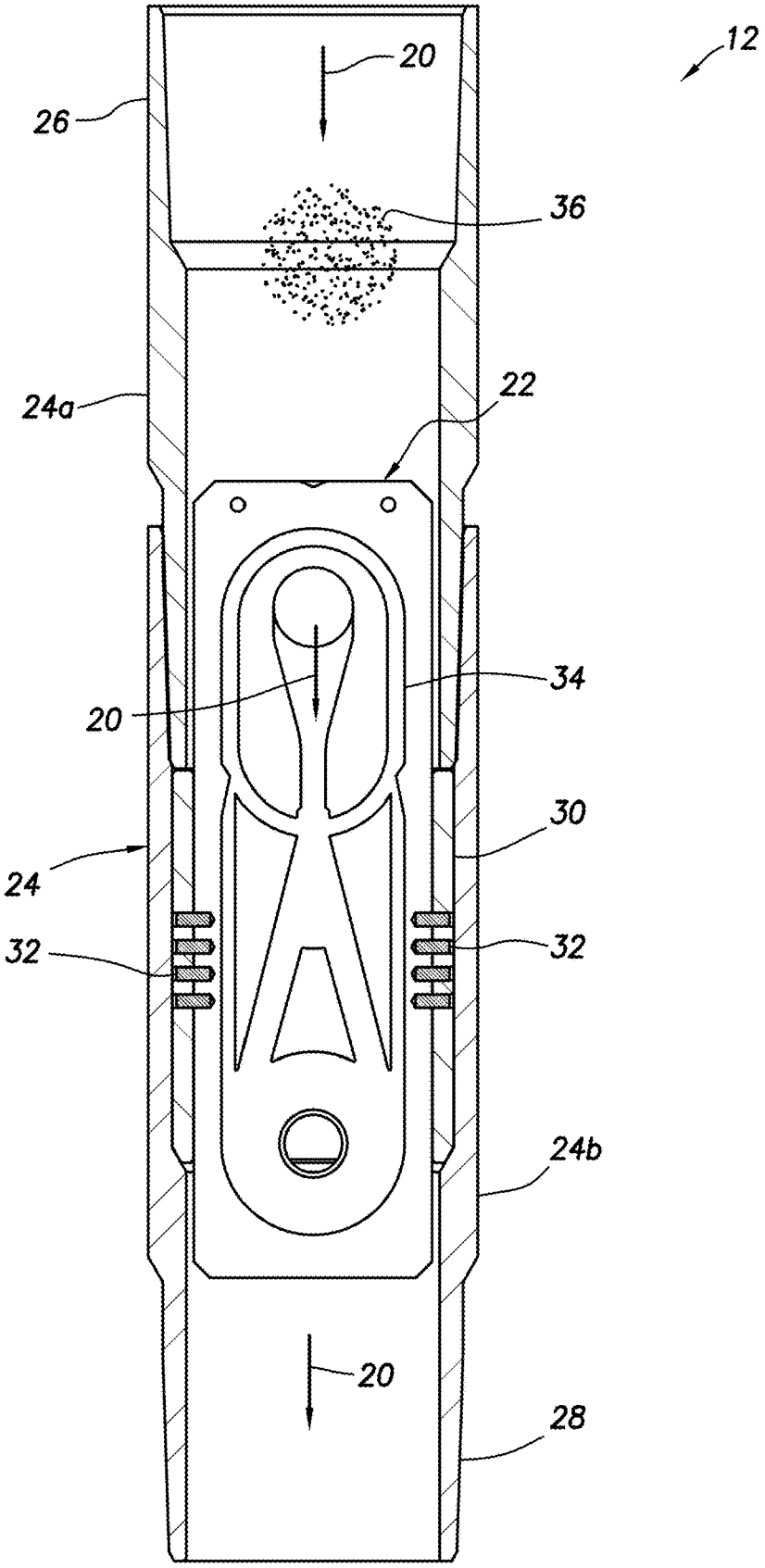
FIG. 2 is a representative cross-sectional view of an example of a downhole releasable vibratory tool.

FIG. 2 depicts one example of a releasable vibratory tool configured for use in a casing string. The tool is described below as it may be used in a casing string, but it should be understood that the tool, suitably configured, may be used in other types of tubular strings (such as, tubing strings, liner strings, etc.).

In FIG. 2 a tool assembly is shown that has a top and bottom housing. A recess within the lower housing contains a sleeve which holds a number of shear pins which also engage an internal fluidic insert. Another type of release member(s) (such as, a shear ring, a snap ring, a releasable lug, etc.) may be used in other examples.

The fluidic insert creates vibration when fluid is pumped through the insert. A number of prior patents exist which describe this type of fluidic device which have proven to be very effective (e.g., U.S. Pat. Nos. 9,181,767 and 9,957,765). The entire disclosures of these prior patents are incorporated herein for all purposes.

In order to release the fluidic insert so that it may be pumped down the casing string, several methods can be used.

Figure 5:
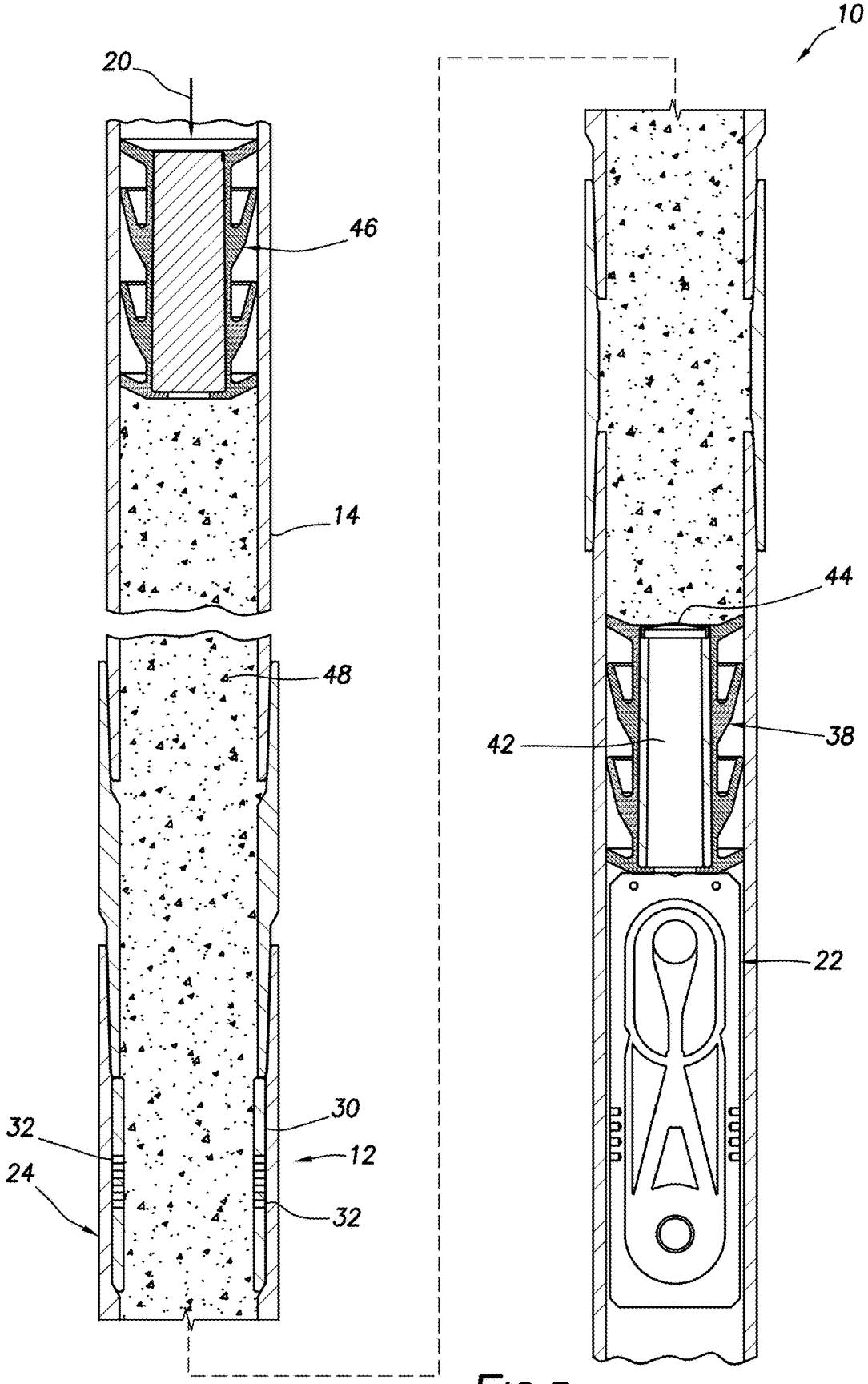
FIG. 5 is a representative cross-sectional view of the downhole releasable vibratory tool as used in an example of a cementing operation.

These include (but are not limited to):

1. Increase a pump rate (flow rate) through the insert so the hydraulic force associated with a pressure drop across the insert shears the pins holding the insert in place.
2. Change the fluid properties (such as, viscosity) of the fluid being pumped through the insert so that the pressure drop across the insert is high enough to cause shearing of the pins.
3. Pump a plugging material down to the insert, causing it to partially or fully plug, so that sufficient hydraulic force can be generated to shear the pins, thereby releasing the insert.
4. Pump a cement plug down to the insert which can be used to generate sufficient force to shear the pins. In normal cementing operations this could be the bottom plug which would have cement above it followed by a top plug. An example of this method is depicted in FIG. 5.

In this example, a burst rating of a rupture disk in the bottom cement plug is higher than the pressure required to shear the pins that retain the insert. After the insert is released, the insert, bottom plug, cement column and top plug are displaced down the wellbore until the insert lands at the bottom of the well, or on top of another releasable casing tool insert.

When the stack of one or more inserts lands at the toe of the well, surface pressure is then raised until the rupture disk in the bottom plug bursts, allowing cement to be displaced through the inserts and float equipment and then circulated through an annulus between the casing and wellbore.

The methods described herein could be accomplished with other types of pressure or time activated release methods. Additionally, a release method that involves time and wellbore exposure can be employed (for instance, dissolvable shear pins, sleeves etc.). Any combination of time, exposure, fluid type (such as, use of acid to dissolve a dissolvable material), temperature, hydraulic force and pressure could also be employed for the release method.

This concept could also be applied to other types of vibratory tools as well. For example, the vibratory tool insert could use the fluid flow to operate a fluid motor which drives a variable flow restrictor device (e.g., see U.S. Pat. Nos. 9,637,976, 11,525,307 and 11,753,901). The entire disclosures of these prior patents are incorporated herein for all purposes.

It is desirable to leave a casing bore that is "full-drift" after completion operations are over. To accomplish this, the shear sleeve can be made of relatively soft material (such as, aluminum or brass) that can easily be displaced or abraded and will therefore not cause issues with future operations that require a full-drift inner diameter in the casing string. Many alloys such as aluminum or magnesium based alloys can be used which will quickly corrode, thereby eliminating a reduced inner diameter.

Referring specifically now to FIG. 1, a partially cross-sectional view of an example of a vibratory tool system 10 and method that can incorporate the principles of this disclosure is representatively illustrated. In this example, multiple spaced apart vibratory tools 12 are connected in a tubular string 14 positioned in a wellbore 16.

A portion of the wellbore 16 is generally horizontal, which can cause difficulties in moving the tubular string 14 through the wellbore. However, it is not necessary for a portion of a wellbore to be horizontal (or nearly horizontal) for the principles of this disclosure to be advantageous.

The tubular string 14 is in contact with an inner wall of the wellbore 16 in the FIG. 1 example. However, in other examples the tubular string 14 could be positioned fully or partially inside another tubular string. Therefore, it should be clearly understood that the scope of this disclosure is not limited to any particular details of the system 10 as depicted in FIG. 1 or described herein.

In this example, the vibratory tools 12 produce vibrations 18 in the tubular string 14 in response to fluid flow 20 through the tubular string. The vibrations 18 may be due to pressure fluctuations and/or variations in flow rate produced by the vibratory tools 12. However, other types of vibratory tools may be used in other examples.

The vibratory tools 12 are specially configured so that they do not substantially restrict fluid flow or access through the tubular string 14 after production of the vibrations 18 is no longer needed (such as, after the tubular string has been deployed into and appropriately positioned in the wellbore 16). As described more fully below, each of the vibratory tools 12 can include an insert that can be released when desired, for example, so that the insert can be displaced with the fluid flow 20 to a distal end of the tubular string 14.

Referring additionally now to FIG. 2, a cross-sectional view of one example of a vibratory tool 12 is representatively illustrated. The FIG. 2 vibratory tool 12 may be used in the FIG. 1 system 10 and method, or it may be used with other systems and methods.

In the FIG. 2 example, a vibratory tool insert 22 is releasably secured in a generally tubular outer housing 24. The outer housing 24 includes upper and lower sections 24*a,b* with respective upper and lower connectors 26, 28 for connecting the vibratory tool 12 in a tubular string (such as, the FIG. 1 tubular string 14).

A release sleeve 30 is retained axially between a lower end of the upper housing section 24*a* and an internal shoulder in the lower housing section 24*b*. Multiple release members 32 extend through the sleeve 30 and into the insert 22.

In this example, the release members 32 are in the form of shear pins, but in other examples, other types of shear members (such as, shear screws, a shear ring, etc.) may be used. In still further examples, other types of releasable members (such as, a snap ring, collets, a latch, etc.) may be used to releasably secure the insert 22 in the housing 24. In another example described below, separate release members 32 may not be used (e.g., the release sleeve 30 may serve as, or comprise, the release member as in the FIGS. 6 & 7 example).

The insert 22 in the FIG. 2 example includes a fluidic device 34 with specially configured flow passages and vortex chambers to produce variations in flow rate and pressure pulses in response to the fluid flow 20 through the insert. The fluidic device 34 may be the same as, or similar to, one or more of those described in the incorporated U.S. Pat. Nos. 9,181,767 and 9,957,765. However, other types of fluidic devices may be used in other examples.

Instead of, or in addition to, the fluidic device 34, the insert 22 could include a fluid motor-driven device that produces variations in flow rate and pressure pulses in response to the fluid flow 20 through the insert. The fluid motor-driven device may be the same as, or similar to, one or more of those described in the incorporated U.S. Pat. Nos. 9,637,976, 11,525,307 and 11,753,901. However, other types of fluid motor-driven devices may be used in other examples.

When used in the FIG. 1 system 10 and method, the vibratory tool 12 will produce the vibrations 18 in response to the fluid flow 20 as the tubular string 14 is deployed into the wellbore 16. Thereafter, when production of the vibrations 18 is no longer needed, the insert 22 can be released, so that it no longer restricts access or flow through the vibratory tool 12.

One technique for releasing the insert 22 is to increase a flow rate of the fluid flow 20, so that an increased pressure differential is created across the insert (due to the restricted flow through the fluidic device 34 in this example). When the pressure differential reaches a predetermined level, the release members 32 will shear, thereby allowing the insert 22 to displace downhole and out of the outer housing 24. The insert 22 may be carried by the fluid flow 22 to the distal end of the tubular string 14 in the FIG. 1 system 10 and method. A number, material and/or dimension of the release members 32 may be varied to thereby change the predetermined pressure differential at which they will shear or otherwise release.

Another technique for releasing the insert 22 is to deploy a plugging material 36 into the tubular string 14, so that it is carried by the fluid flow 20 to the insert, where the plugging material will fully or substantially restrict the fluid flow through the insert. For example, the plugging material 36 could comprise a gelatinous, particulate or granular material. The plugging material 36 could be swellable or dissolvable in well fluids.

Another technique for releasing the insert 22 is to change a property of the fluid flow 20, so that the pressure differential across the insert is increased. For example, a viscosity of one or more fluids in the fluid flow 20 could be increased to thereby increase the pressure differential across the insert 22.

Yet another technique for releasing the insert 22 is to dissolve or otherwise degrade the release members 32, the release sleeve 30 or any other member that retains the insert in the outer housing 24. The retaining member may degrade or dissolve due to passage of time, exposure to downhole temperatures, exposure to well fluids (either natural (e.g., formation fluid) or introduced (e.g., an acid or other altered pH)), exposure to radiation, or another condition.

Figure 3:
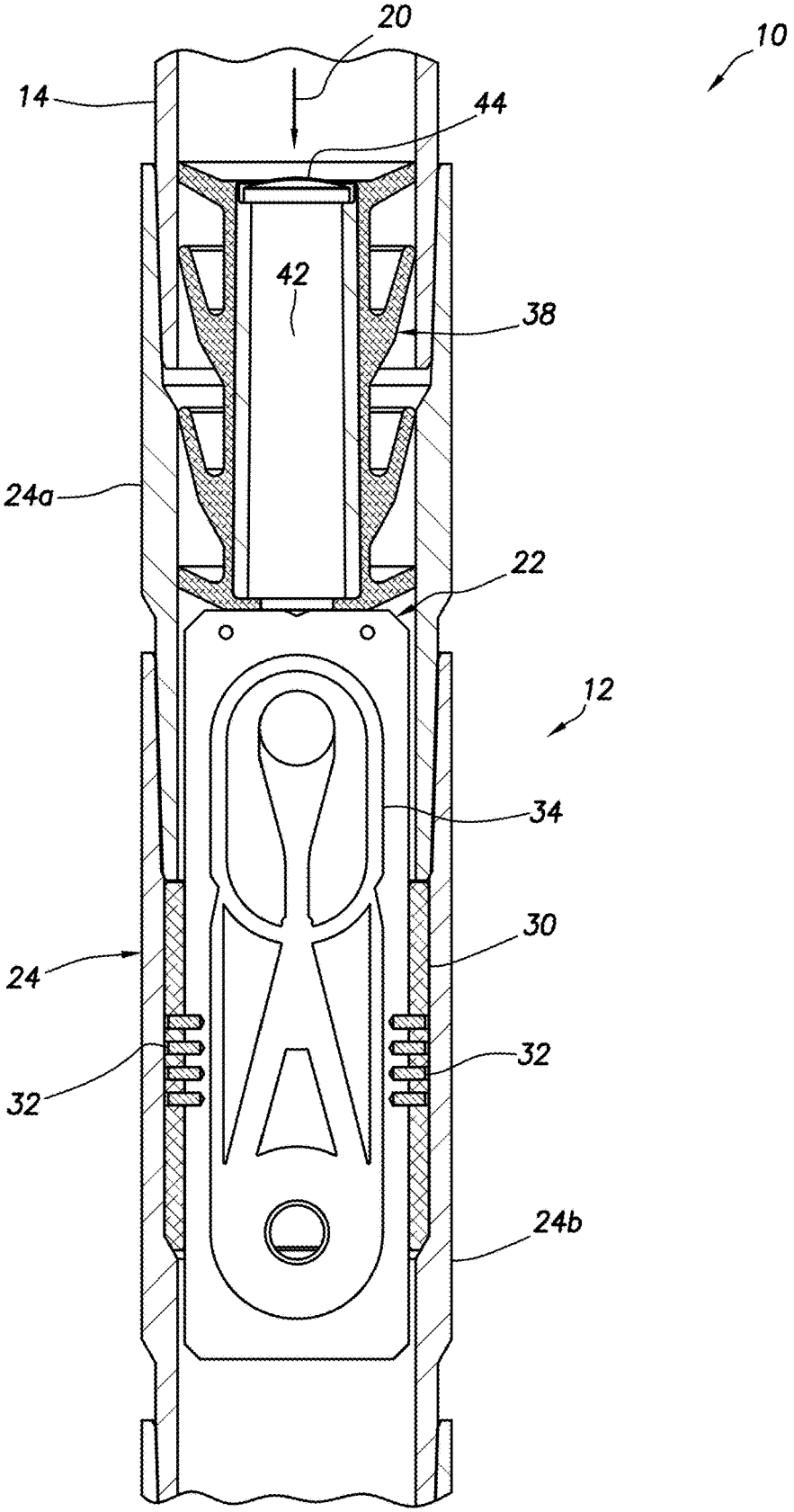
FIG. 3 is a representative cross-sectional view of the downhole releasable vibratory tool connected in a casing string.

Referring additionally now to FIG. 3, another technique for releasing the insert 22 is representatively illustrated. In this technique, a plug 38 is deployed into the tubular string 14. The fluid flow 20 carries the plug 38 through the tubular string 14 to the vibratory tool 12.

As depicted in FIG. 3, the plug 38 has contacted an upper end of the insert 22. A predetermined pressure differential can now be created across the plug 38 to shear the release members 32 or otherwise release the insert 22 from the outer housing 24. For example, a pump 40 at the surface (see FIG. 1) can be used to increase pressure in the tubular string 14 uphole of the plug 38.

In this example, the plug 38 is in the form of a cementing plug of the type used in cementing operations. The plug 38 has an internal longitudinal flow passage 42 formed therein, which is initially blocked at its upper end by a rupture disk 44. In other examples, other types of plugs (such as, darts, balls, etc.) may be used.

Figure 4:
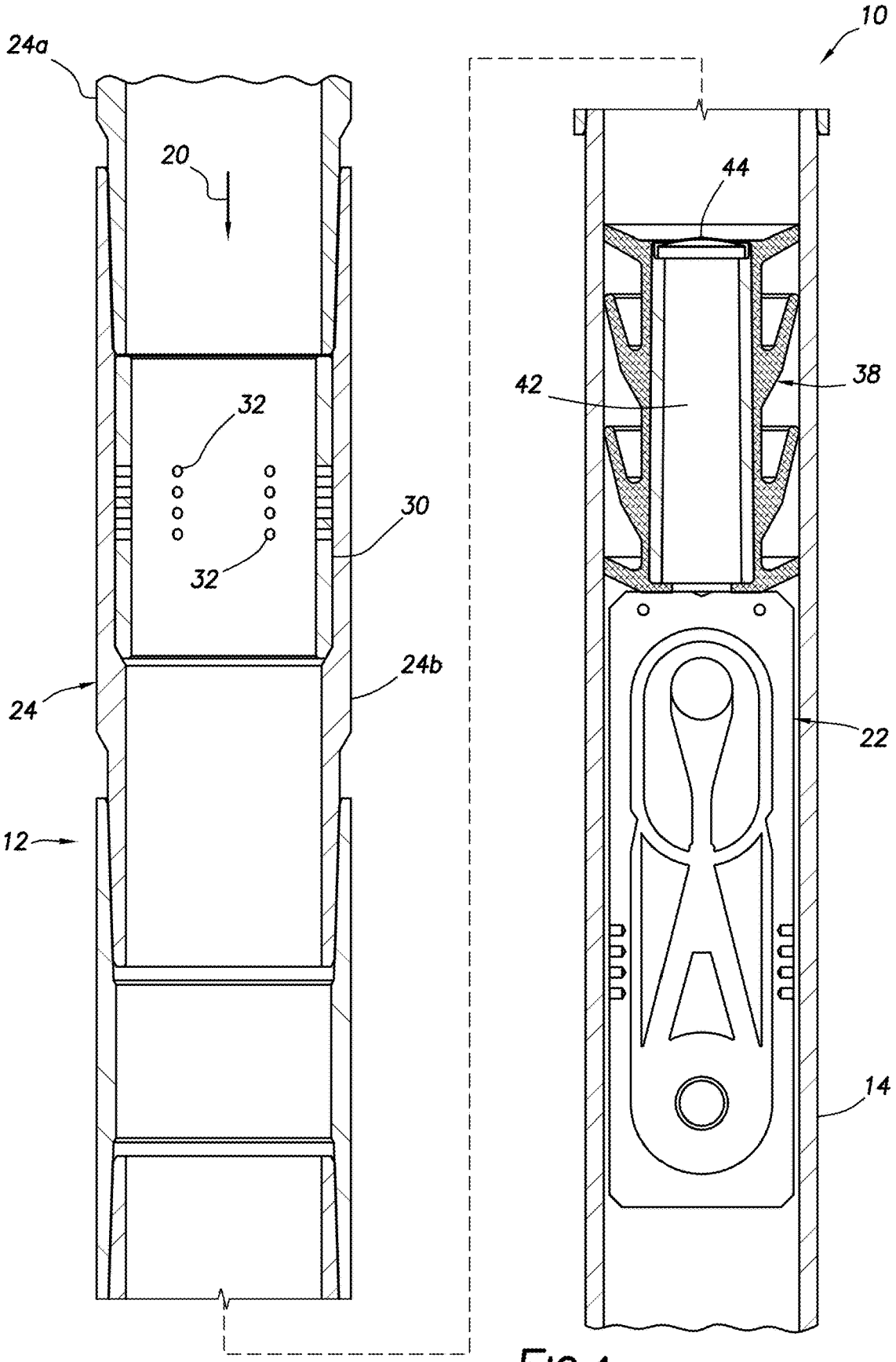
FIG. 4 is a representative cross-sectional view of the downhole releasable vibratory tool released in the casing string.

Referring additionally now to FIG. 4, a cross-sectional view of the vibratory tool system 10 is representatively illustrated after the insert 22 has been released from the outer housing 24 of the vibratory tool 12. The insert 22 and the plug 38 are being carried downhole by the fluid flow 20 (such as, to a toe or distal end of the tubular string 14).

If another vibratory tool 12 is connected in the tubular string 14 downhole of the vibratory tool depicted in FIG. 4, the insert 22 depicted in FIG. 4 will eventually contact the insert of the next vibratory tool connected in the tubular string. The predetermined pressure differential can again be created across the plug 38 to thereby release the next insert 22 from the outer housing 24.

This process can be repeated as many times as there are additional vibratory tools 12 connected in the tubular string 14. Note, however, that it is not necessary for the predetermined pressure differential applied across the plug 38 to release the insert 22 to be the same for every vibratory tool 12 connected in the tubular string 14.

When the plug 38 can no longer be displaced with the fluid flow 20 through the tubular string 14 (such as, when all of the inserts 22 have been released from their respective outer housings 24, and the plug and inserts have reached the toe or distal end of the tubular string), a predetermined pressure differential can be created across the plug 38 in order to burst the rupture disk 44 and thereby permit fluid flow through the flow passage 42.

In this manner, relatively unrestricted fluid flow through the tubular string 14 can be achieved after it is no longer desired to produce the vibrations 18 with the vibratory tools 12. The pressure differential level required to burst the rupture disk 44 is preferably greater than the pressure differential level required to release any of the inserts 22 from the respective outer housings 24.

Referring additionally now to FIG. 5, the vibratory tool system 10 is representatively illustrated as used in an example cementing operation. As depicted in FIG. 5, the insert 22 has been released from the outer housing 24 by creating a predetermined pressure differential across the plug 38, and the insert and the plug have displaced downhole from the outer housing, similar to the FIG. 4 example.

In the FIG. 5 example, the plug 38 is a lower cementing plug. An upper cementing plug 46 is deployed into the tubular string 14 uphole of the lower cementing plug 38. Cement 48 is placed in the tubular string 14 between the plugs 38, 46.

The fluid flow 20 displaces the plugs 38, 46 and the cement 48 through the tubular string 14, until the lower plug 38 contacts the insert 22. A predetermined pressure differential is created across the plugs 38, 46 and cement 48 to thereby release the insert 22 from the outer housing 24 (for example, by shearing the release members 32. The fluid flow can then displace the plugs 38, 46, the cement 48 and the insert 22 further downhole. Additional inserts 22 may also be released from additional outer housings 24 of any respective additional vibratory tools 12, as described above for the FIG. 4 example.

When the insert(s) 22, plugs 38, 46 and cement 48 reach the toe or distal end of the tubular string 14, a float shoe (not shown) may be opened and the rupture disk 44 may be opened as described above, thereby allowing the cement 48 to be flowed outward and into an annulus 50 (see FIG. 1) formed between the tubular string 14 and the wellbore 16. Note that it is not necessary for the insert(s) 22, plugs 38, 46 and cement 48 to be displaced to the toe or distal end of the tubular string 14. A float collar could, for example, be connected in the tubular string 14 uphole of the toe or distal end.

Figure 6:
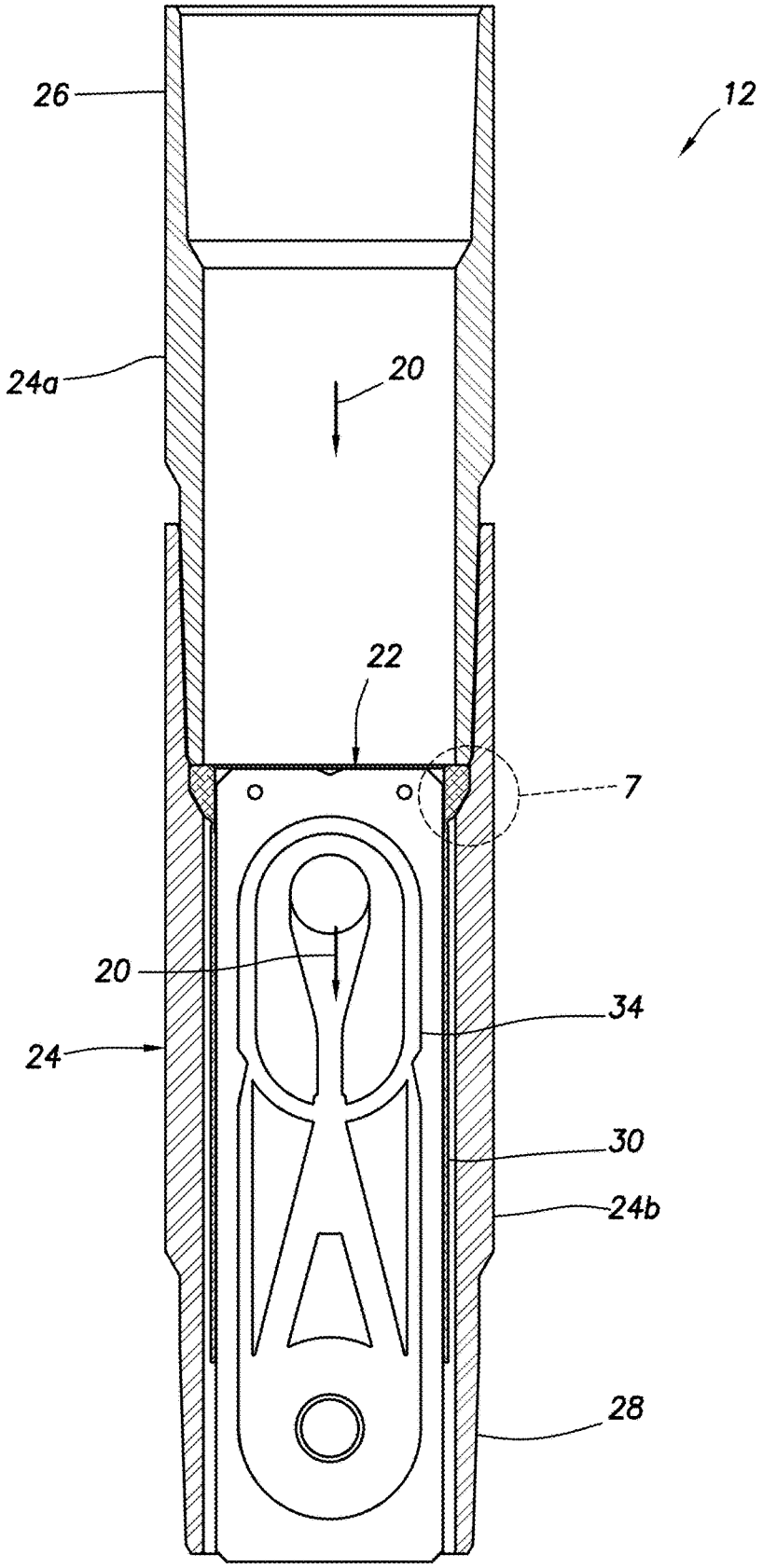
FIG. 6 is a representative cross-sectional view of another example of the downhole releasable vibratory tool.

Referring additionally now to FIG. 6, another example of the vibratory tool 12 is representatively illustrated. The FIG. 6 vibratory tool 12 may be used in place of the FIGS. 2-5 vibratory tool, and may be used in the FIG. 1 system 10 and method, or in other systems and methods.

In the FIG. 6 example, the release members 32 are not used. Instead, the release sleeve 30 releasably secures the insert 22 in the outer housing 24. Alternatively, it may be considered that the release sleeve 30 incorporates a release member therein, as described more fully below.

Operationally, the FIG. 6 example is substantially similar to the FIGS. 2-5 example. A predetermined pressure differential created across the insert 22, or across a plug engaged with the insert, will cause the insert to be released from the outer housing 24 and displaced downhole. Alternatively, the release sleeve 30, or a portion thereof, may be dissolved or otherwise degraded to cause the insert 22 to be released from the outer housing 24.

Figure 7:
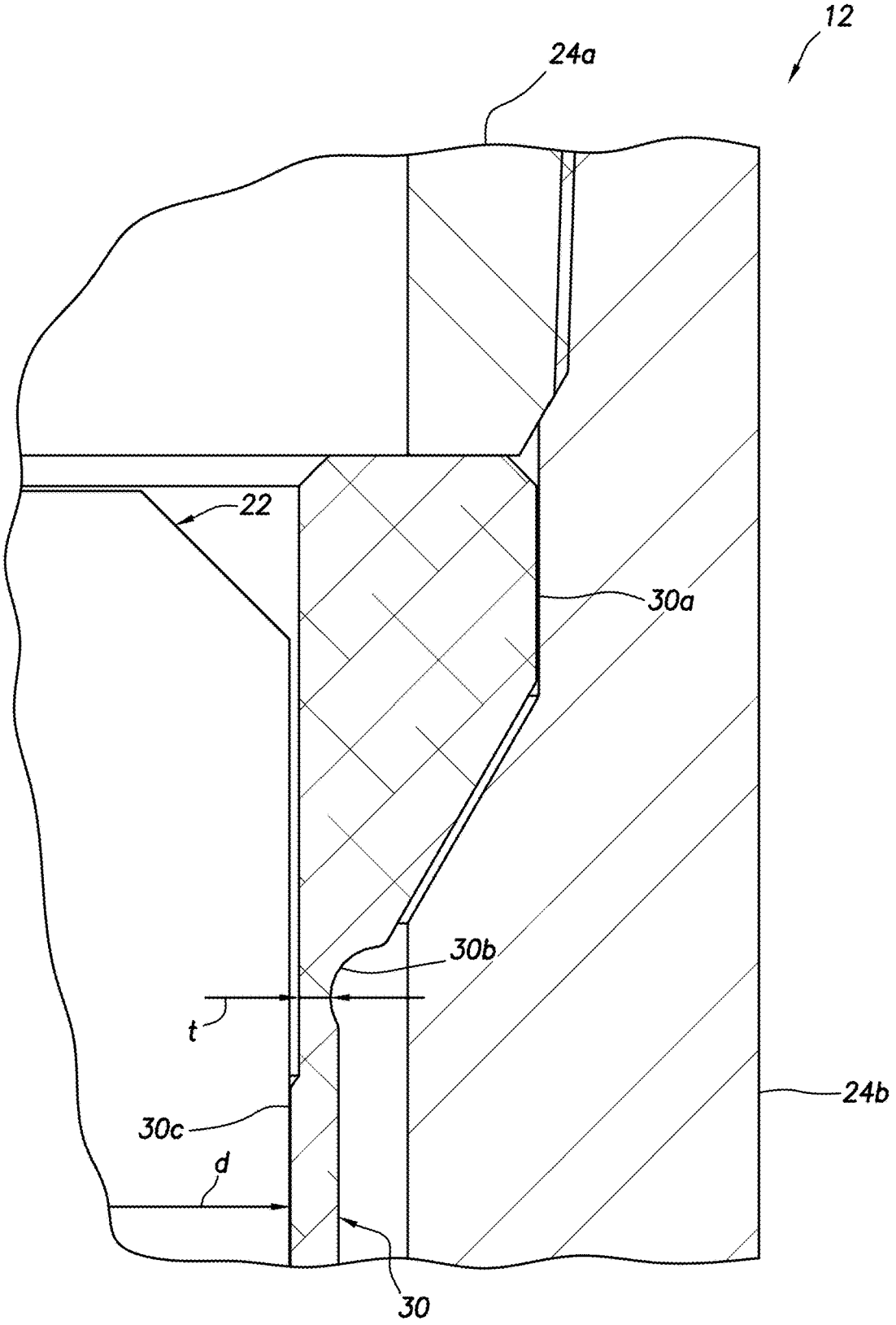
FIG. 7 is a representative cross-sectional view of a portion of the FIG. 6 downhole releasable vibratory tool.

Referring additionally now to FIG. 7, an enlarged detail 7 of a portion of the vibratory tool 12 is representatively illustrated. Specifically, FIG. 7 depicts an upper portion of the release sleeve 30 retained between the lower end of the upper outer housing section 24*a* and the internal shoulder in the lower outer housing section 24*b*.

In the FIG. 7 detail, it may be seen that the release sleeve 30 includes a radially enlarged upper section 30*a* that is retained between the upper and lower outer housing sections 24*a,b*. The release sleeve 30 also includes a radially reduced section 30*b* and a cylindrical retainer section 30*c*. The radially reduced section 30*b* is positioned axially between the radially enlarged section 30*a* and the cylindrical retainer section 30*c*.

An inner diameter d of the cylindrical retainer section 30*c* is dimensioned so that the insert 22 can be press fit therein. Alternatively, an internal shoulder, snap ring or other structure may be provided to prevent downhole displacement of the insert 22 relative to the cylindrical retainer section 30*c*.

The radially reduced section 30*b* is configured to break when the predetermined pressure differential is created across the insert 22 or a plug 38 engaged with the insert. For example, a radial thickness t of the radially reduced section 30*b* may be selected to produce the desired pressure differential at which the radially reduced section will break. A material of the release sleeve 30 may be varied to change the pressure differential at which the radially reduced section 30*b* will break.

In some examples, the release sleeve 30 may be dissolved, eroded, corroded or otherwise degraded in order to release the insert 22 from the outer housing 24. In the FIG. 7 example, the thickness t of the radially reduced section 30*b* may be selected to produce a desired amount of time for the radially reduced section to dissolve/degrade and part to thereby release the insert 22.

Figure 8:
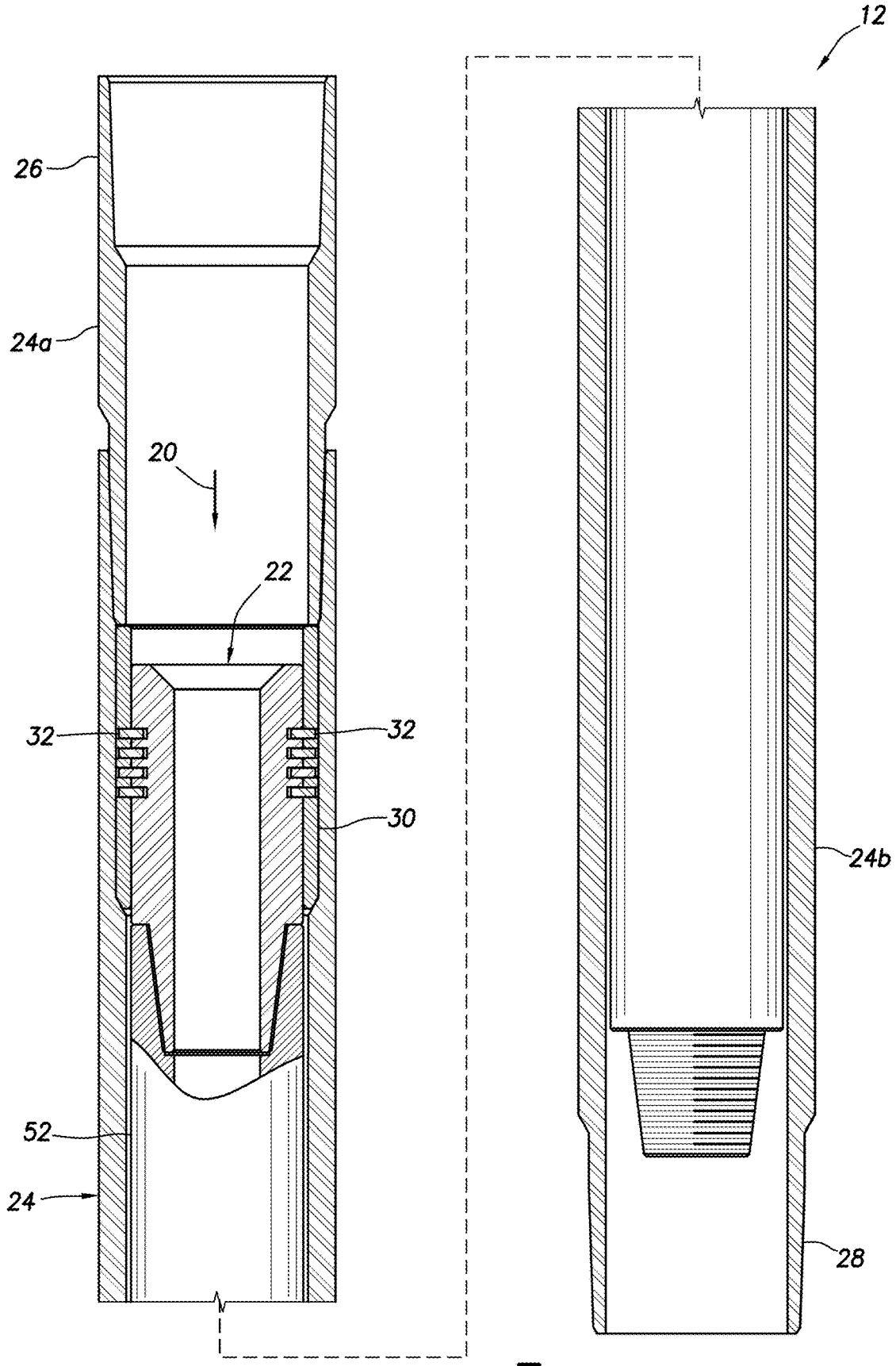
FIG. 8 is a representative partially cross-sectional view of another example of the downhole releasable vibratory tool.

Referring additionally now to FIG. 8, a partially cross-sectional view of another example of the vibratory tool 12 is representatively illustrated. In this example, the insert 22 is not of the type that includes the fluidic device 34 described above. The FIG. 8 insert 22 can instead include other types of vibratory device 52, such as, any of the fluid motor-driven devices described in the incorporated U.S. Pat. Nos. 9,637,976, 11,525,307 and 11,753,901.

Note that it is not necessary for the vibratory device 52 to generate the vibrations 18 in response to fluid flow 20 through the device. In some examples, the vibratory device 52 could be battery-powered (such as, a piezoelectric device) or could be otherwise powered. Thus, the scope of this disclosure is not limited to use of any particular type, configuration or operation of the vibratory device 52.

It may now be fully appreciated that the above disclosure provides significant advances to the art of designing, constructing and utilizing vibratory tool systems with subterranean wells. In an example described above, a vibratory tool insert 22 is releasably retained in an outer housing 24 of a vibratory tool 12, and the insert is released when production of vibrations 18 is no longer desired and relatively unrestricted access and fluid flow through the vibratory tool is desired.

A downhole releasable vibratory tool 12, system 10 and method are described above, in which a vibratory tool insert 22 is releasably secured in a tubular string 14.

The vibratory tool insert 22 may be retained by shearable members 32 in a housing 24 configured for connection in the tubular string 14.

A sleeve 30 may be disposed in the housing 24, and the shearable members 32 may extend through the sleeve and into the vibratory tool insert 22.

The sleeve 30 may be configured to dissolve, erode or otherwise degrade, to thereby enlarge an inner diameter of the tool 12, after the insert 22 has been released.

The vibratory tool insert 22 may be released by increasing a fluid flow rate through the insert, so a hydraulic force associated with a pressure differential across the insert shears shear members or other retainer members 32 holding the insert in place.

The vibratory tool insert 22 may be released by changing one or more fluid properties (such as, viscosity) of the fluid being pumped through the insert, so that the pressure differential across the insert is sufficient to cause shearing of the pins or release of another type of release member 32.

The vibratory tool insert 22 may be released by pumping a plugging material 36 down to the insert, causing it to partially or fully plug, so that sufficient hydraulic force can be generated to shear the pins or release another type of release member 32, thereby releasing the insert.

The vibratory tool insert 22 may be released by pumping a cementing plug 38 down to the insert to thereby generate sufficient force to shear the pins or release another type of release member 32. In cementing operations this could be the lower plug 38 which would have cement 48 above it followed by an upper plug 46.

The tool 12 may include a fluidic vibratory tool insert 22 or a fluid motor-type vibratory tool insert 22.

The above disclosure provides to the art a vibratory tool 12 for use in a subterranean well. In one example, the vibratory tool 12 can comprise: an outer housing 24, an insert 22 configured to produce vibrations 18 in a tubular string 14 in the well, and a release member 30, 32 that releasably secures the insert 22 in the outer housing 24.

The release member 32 may comprise a shear member. The shear member 32 may extend through a release sleeve 30 secured between the insert 22 and the outer housing 24.

The release member 30 may comprise a release sleeve secured between the insert 22 and the outer housing 24. The release sleeve 30 may be configured to part in response to a predetermined pressure differential created across the insert 22 or across a plug 38 engaged with the insert 22.

The release member 30, 32 may be configured to degrade in the well.

The insert 22 may comprise a fluidic device 34. The insert 22 may be press fit in a release sleeve 30 secured between the insert 22 and the outer housing 24.

The release sleeve 30 may be secured in the outer housing 24 between the insert 22 and the outer housing 24. The release sleeve 30 may be configured to degrade in the well.

A method for use with a subterranean well is also provided to the art by the above disclosure. In one example, the method can comprise: connecting at least one vibratory tool 12 in a tubular string 14, the vibratory tool 12 including an insert 22 releasably secured in an outer housing 24; positioning the tubular string 14 in the well; then releasing the insert 22 from the outer housing 24 in the well; and displacing the insert 22 through the tubular string 14.

The releasing step may include creating a predetermined pressure differential across the insert 22 or across a plug 38 engaged with the insert 22.

The method may include displacing cement 48 through the tubular string 14 uphole of the plug 38.

The releasing step may include shearing a release member 32 of the vibratory tool 12.

The releasing step may include parting a release sleeve 30 secured between the insert 22 and the outer housing 24.

The releasing step may include deploying a plugging material 36 into the tubular string 14 uphole of the vibratory tool 12.

The method may include, after the releasing step, degrading a release sleeve 30 secured between the insert 22 and the outer housing 24.

The releasing step may include degrading a release sleeve 30 secured between the insert 22 and the outer housing 24.

The connecting step may include connecting multiple vibratory tools 12 in the tubular string 14. The releasing step may include releasing the insert 22 of each of the vibratory tools 12 from the respective outer housing 24 of each of the vibratory tools 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A vibratory tool for use in a subterranean well, the vibratory tool comprising:

an outer housing;

an insert configured to produce vibrations in a tubular string in the well; and a release member that releasably secures the insert in the outer housing, in which the release member is configured to release the insert in response to a predetermined pressure differential created across the insert.

2. The vibratory tool of claim 1, in which the release member comprises a shear member.

3. The vibratory tool of claim 2, in which the shear member extends through a release sleeve secured between the insert and the outer housing.

4. The vibratory tool of claim 1, in which the release member comprises a release sleeve secured between the insert and the outer housing.

5. The vibratory tool of claim 4, in which the release sleeve is configured to break in response to the predetermined pressure differential created across the insert.

6. The vibratory tool of claim 1, in which the release member is configured to degrade in the well.

7. The vibratory tool of claim 1, in which the insert comprises a fluidic device.

8. The vibratory tool of claim 1, in which the insert is press fit in a release sleeve secured between the insert and the outer housing.

9. The vibratory tool of claim 1, in which a release sleeve is secured in the outer housing between the insert and the outer housing, and in which the release sleeve is configured to degrade in the well.

10. A method for use with a subterranean well, the method comprising:

connecting at least one vibratory tool in a tubular string, the vibratory tool including an insert releasably secured in an outer housing;

positioning the tubular string in the well;

creating a predetermined pressure differential across the insert, thereby releasing the insert from the outer housing in the well; and displacing the insert through the tubular string.

11. The method of claim 10, in which the releasing further comprises shearing a release member of the vibratory tool.

12. The method of claim 10, in which the releasing further comprises breaking a release sleeve secured between the insert and the outer housing.

13. The method of claim 10, in which the releasing further comprises deploying a plugging material into the tubular string uphole of the vibratory tool.

14. The method of claim 10, further comprising, after the releasing, degrading a release sleeve secured between the insert and the outer housing.

15. The method of claim 10, in which the connecting comprises connecting multiple vibratory tools in the tubular string, and in which the releasing comprises releasing the insert of each of the vibratory tools from the respective outer housing of each of the vibratory tools.

16. A vibratory tool for use in a subterranean well, the vibratory tool comprising:

an outer housing;

an insert configured to produce vibrations in a tubular string in the well; and a release member that releasably secures the insert in the outer housing, in which the release member comprises a release sleeve secured between the insert and the outer housing, and in which the release sleeve is configured to break in response to a predetermined pressure differential created across a plug engaged with the insert.

17. A method for use with a subterranean well, the method comprising:

connecting at least one vibratory tool in a tubular string, the vibratory tool including an insert releasably secured in an outer housing;

positioning the tubular string in the well;

degrading a release member that releasably secures the insert in the outer housing, thereby releasing the insert from the outer housing in the well; and displacing the insert through the tubular string.

18. The method of claim 17, in which the release member comprises a shear member.

19. The method of claim 18, in which the shear member extends through a release sleeve secured between the insert and the outer housing.

20. The method of claim 17, in which the release member comprises a release sleeve secured between the insert and the outer housing.

* * * * *